US006132058A

United States Patent [19]

Kuo

[11] Patent Number: 6,132,058

[45] Date of Patent: Oct. 17, 2000

[54] ILLUMINATING CASING FOR RECEIVING A HANDLE OF A KEY

[76] Inventor: Lambert Kuo, No. 16, Lane 459, Sec. 1, An Ho Rd., Tainan, Taiwan

[21] Appl. No.: 09/302,271

[22] Filed: Apr. 28, 1999

Related U.S. Application Data

[63] Continuation-in-part of application No. 08/947,800, Oct. 8, 1997, abandoned.

[51] Int. Cl.[7] ..... F21V 33/00; F21L 4/00

[52] U.S. Cl. ..... 362/116; 362/200; 70/454; 70/459

[58] Field of Search ..... 362/116, 119, 362/196, 200, 201; 70/408, 456 R, 454, 459

[56] References Cited

U.S. PATENT DOCUMENTS

| | | | |
|---|---|---|---|
| 3,119,564 | 1/1964 | Zalman | 70/459 |
| 3,613,414 | 10/1971 | Ostrager | 362/116 |
| 4,085,315 | 4/1978 | Wolter et al. | 362/116 |
| 4,276,582 | 6/1981 | Burnett | 362/116 |
| 4,392,186 | 7/1983 | Cziment | 362/116 |
| 4,521,833 | 6/1985 | Wolter | 362/116 |

*Primary Examiner*—Alan Cariaso
*Attorney, Agent, or Firm*—Dellett and Walters

[57] ABSTRACT

An illuminating casing for receiving a handle of a key includes a lower shell and an upper shell wherein a top extends laterally from the peripheral wall of the lower shell so as to define a chamber for receiving the handle. A light is disposed beside the top and a battery is disposed between the top and the upper shell which has a button disposed thereto. The top has a tongue extending therefrom and has an inclined surface forward of the bottom of the lower shell. The handle of the key has an aperture defined therethrough so that when the handle is inserted into the chamber, the tongue is pushed slightly by the handle, and when the handle slides over the tongue, the distal end of the tongue is securely engaged with the aperture of the handle.

14 Claims, 3 Drawing Sheets

ILLUMINATING CASING FOR RECEIVING A HANDLE OF A KEY

The present invention is a continuation-in-part application of U.S. patent application Ser. No. 08/947,800, filed on Oct. 8, 1997 now abandoned.

BACKGROUND OF THE INVENTION

1. Field of the Invention

The present invention relates to an illuminating casing for receiving a handle of a key, wherein the key will not drop when replacing the battery by separating the casing into two parts.

2. Brief Description of the Prior Art

In order to provide an illuminating feature when using a key in the dark to let the user locate the keyhole in a door, an illuminating casing for receiving the handle of a key is developed and disclosed in U.S. Pat. No. 3,613,414 to Ostrager, U.S. Pat. No. 4,085,315 to Wolter et al., U.S. Pat. No. 4,392,186 to Cziment and U.S. Pat. No. 5,386,351 to Tabor. The casing retains the handle of a key and has a battery and a light received therein so that when pushing a button on the casing, the light turns on to illuminate the keyhole. Each casing in the prior patents mentioned above is composed of at least two parts which are connected together with each other by screws(s) so that the battery and the handle of the key are clamped between the two parts. When replacing the battery in the casing, the two parts are to be separated so as to remove the battery from the casing and place a new battery in the casing. However, the key will drop when the casing is separated into two parts. In other words, the user has to position the key and the battery carefully in one of the two parts and then cover the other part to assemble the casing.

The present invention intends to provide an improved illuminating casing for receiving a handle of a key wherein the handle is secured in a chamber in one of two parts of the casing so that the key will not drop when replacing the battery.

SUMMARY OF THE INVENTION

The present invention provides an illuminating casing which includes a lower shell having a bottom and a peripheral wall extending from the edge defining the bottom. The top extends laterally from the peripheral wall, and a side plate extends from the bottom and is connected to the top so as to define a chamber between the top, the bottom and the side plate. An insertion slot is defined in the peripheral wall and communicates with the chamber so as to receive the handle of a key. A tongue extends from the top and has an inclined surface toward the bottom of the lower shell. A groove is defined in the top surface of the top. An opening is defined in the peripheral wall and located beside the insertion slot so as to receive a light therein.

A upper shell has a body with a peripheral wall extending from the body. The upper shell is mountable to the lower shell and has a button attached thereto. The light has two wires extending therefrom, wherein one of the wires is received in the groove and the other wire is located on the underside of the button.

A battery is located on the top and below the button with a gap defined between the button and the battery when the button is not pushed. The handle of the key has an aperture which is engaged with the distal end of the inclined surface.

It is an object of the present invention to provide an illuminating casing for receiving the handle of a key therein that is engaged with a tongue in the casing so that when replacing the battery in the casing, the key will not drop.

Other objects, advantages, and novel features of the invention will become more apparent from the following detailed description when taken in conjunction with the accompanying drawings.

DETAILED DESCRIPTION OF THE PREFERRED EMBODIMENT

Figure 6:
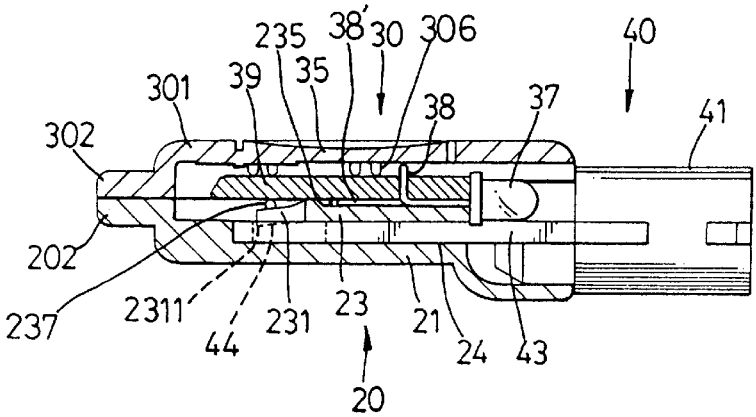
FIG. 6 is a side elevational view, partly in section, of the illuminating casing in FIG. 1 wherein the aperture defined in the handle of the key is engaged with the tongue, and the battery is compressed by the bosses extending from the upper shell.
Figure 7:
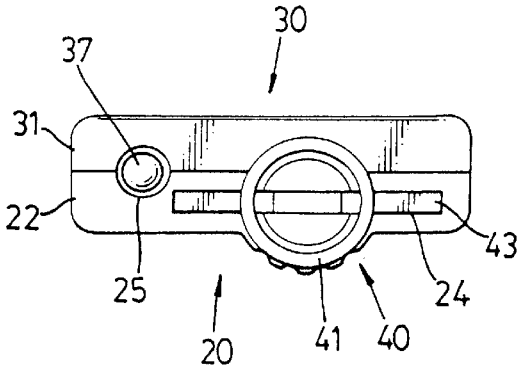
FIG. 7 is a plan view to show the casing with the light and the key connected thereto.

Referring to FIGS. 1, 2, 5 and 7, an illuminating casing in accordance with the present invention generally includes a lower shell (20) having a bottom (21) and a peripheral wall (22) extending from the edge defining the bottom (21). A top (23) extends laterally from the peripheral wall, and a side plate (230) extends from the bottom (21) so as to be connected to the top (23) to define a chamber between the top (23), the bottom (21) and the side plate (230). An insertion slot (24) is defined in the peripheral wall (22) and located beneath the first end of the top (23). The insertion slot (24) communicates with the chamber so that the handle (43) of a key (40) is inserted into the chamber via the insertion slot (24). A semi-circular recess (220) is defined in the peripheral wall (22) of the lower shell (20), and the semi-circular recess (220) communicates with the insertion slot (24) so that the shank (41) of the key (40) is received in the semi-circular recess (220). Further referring to FIG. 3, a tongue (231) extends from the second end of the top (23) and has an inclined surface (2310) toward the bottom (21) of the lower shell (20). A protrusion (237) extends from the opposite side of the tongue (231) from the inclined surface (2310). Referring to FIG. 6, the handle (43) of the key (40) has an aperture (44) defined therethrough so that when the handle (43) is inserted into the chamber via the insertion slot (24), the tongue (231) is pushed upwardly by the handle (43) and when the handle (43) slides over the tongue (231), and the distal end (2311) of the inclined surface (2310) is engaged with the aperture (44). The lower shell (20) has a tube (26) extending from the bottom (21) thereof and the tube (26) has a threaded hole (261) defined therein.

A groove (235) is defined in a top surface of the top (23). A first engaging member (233) and a stop (236) respectively extend from the top (23) of the lower shell (20), wherein the first engaging member (233) is a hook member. A first lug (202) extends from the lower shell and has a first slot (204) and two holes (203) respectively defined therethrough. An opening (25) is defined in the peripheral wall (22) and located beside the insertion slot (24) so as to receive a light (37) therein.

Figure 4:
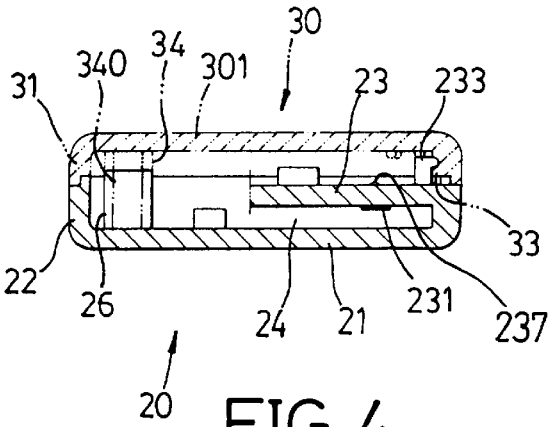
FIG. 4 is a side elevational view, partly in section, of the illuminating casing in FIG. 1 and shows the engagement of the first engaging member and the second engaging member when the lower shell and the upper shell are connected with each other.
Figure 5:
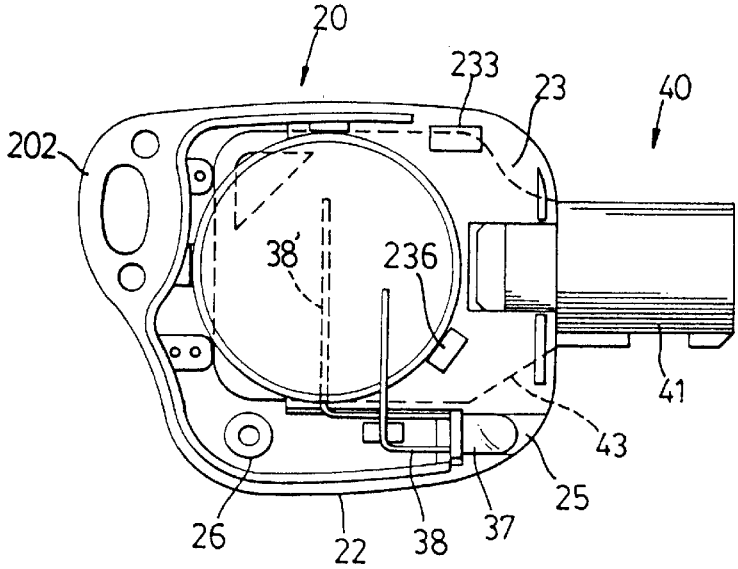
FIG. 5 is a top plan view to show a battery and a light respectively disposed in the lower shell in accordance with the present invention.

The upper shell (30) has a body (301) with a peripheral wall (31) extending from the body (301). The upper shell (30) is removably mounted to the lower shell (20). A button (35) made of flexible material is attached to the upper shell (30) and a plurality of bosses (306) extend from the underside of the body (301), wherein the bosses (306) are located around the button (35). The light (37) has two L-shaped wires (38, 38') extending therefrom, one of the wires (38) received in the groove (235) and the other wire (38') located on the underside of the button (35). The upper shell (30) has a second engaging member (33) extending laterally inward from the peripheral wall (31) thereof, and the second engaging member (33) has a notch (330) defined therein so as to receive the first engaging member (233). The upper shell (30) has a positioning hole (34) defined therethrough which is in alignment with the threaded hole (261) so that a bolt (341) extends through the positioning hole (34) and is threadedly engaged with the threaded hole (261) to connect the lower shell (20) and the upper shell (30). Two positioning posts (340) extend from the underside of the body (301) of the upper shell (30) to guide the tube (26) between the two positioning posts (340) when the upper shell (30) is mounted to the lower shell (20) as shown in FIG. 4. The upper shell (30) has a second lug (302) extending therefrom which has a second slot (304) defined therethrough which is in alignment with the first slot (204). The second lug (302) further has two studs (303) respectively extending therefrom so as to be received in the two holes (203) of the first lug (202) of the lower shell (20).

A battery (39) is located on the top (23) and below the button (35) with a gap defined between the button (35) and the battery (39) when the button (35) is not pushed. The battery (39) is positioned by contacting the stop (236) so that the battery (39) will not slide. Therefore, when pressing the button (35), the wire (38) is pushed to contact the battery (39) so as to let the light (37) turn on.

Figure 1:
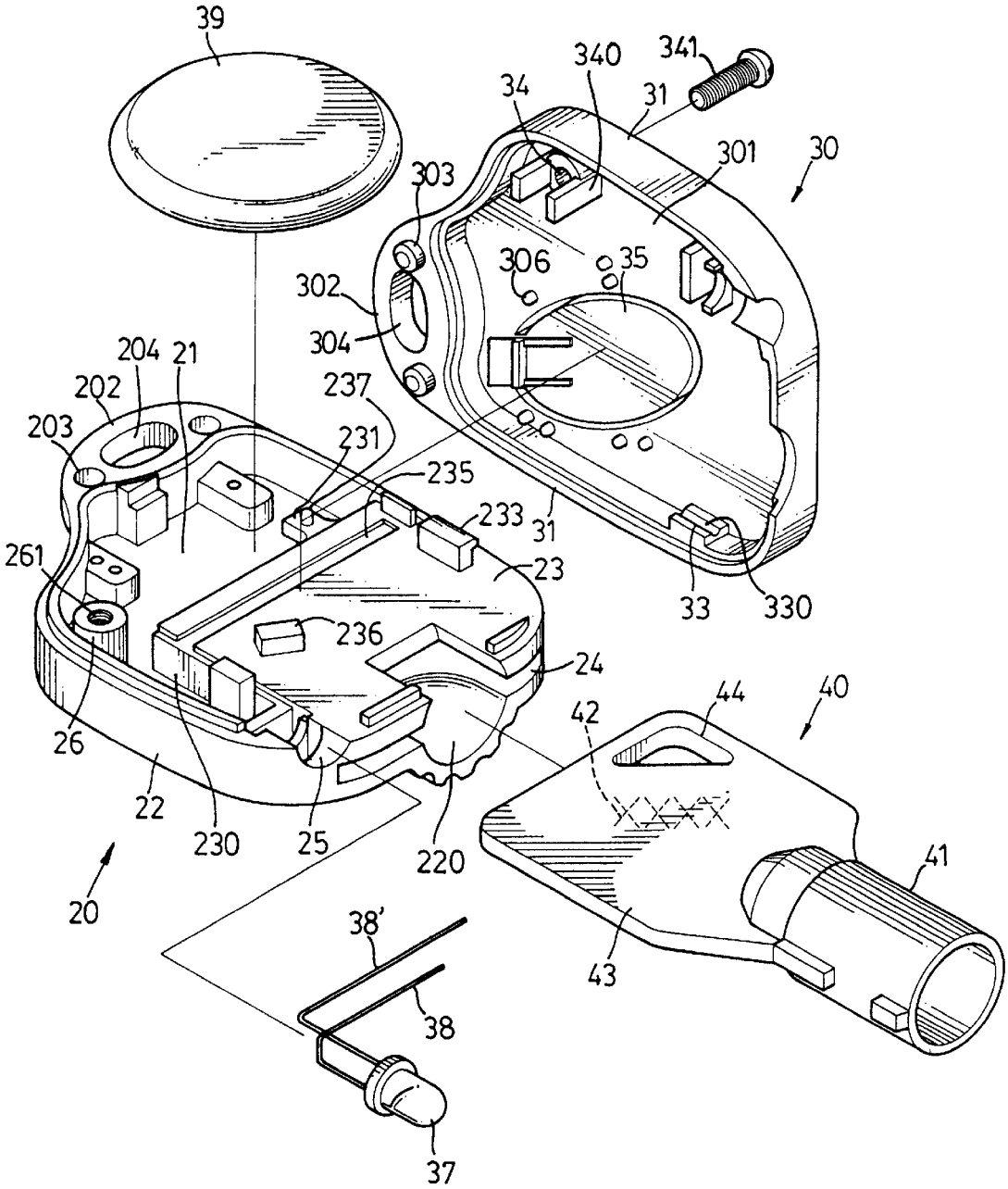
FIG. 1 is an exploded view of a key and an illuminating casing in accordance with the present invention.
Figure 2:
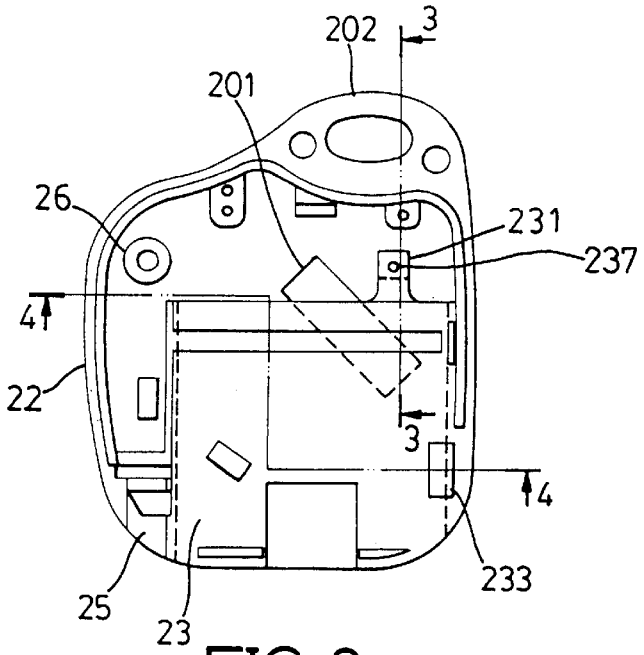
FIG. 2 is a top view of the lower shell of the illuminating casing in FIG. 1.
Figure 3:
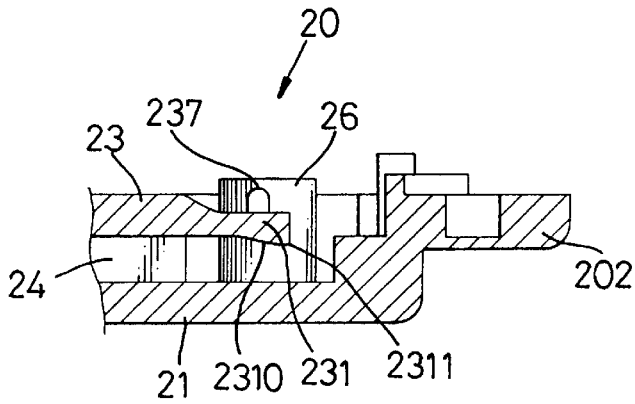
FIG. 3 is a side elevational view, partly in section and enlarged, of a portion of the lower shell in FIG. 2 to show the tonguelower shell.

A mark (42) showing the type of the key (40) is printed on the handle (43) and the lower shell (20) has a transparent window (201) defined in the bottom (21) thereof as shown in FIG. 2 so that the mark (42) can be seen via the window (201) to let a user (not shown) distinguish the key (40).

When replacing the battery (39), the upper shell (30) is removed from the lower shell (20) by unthreading the bolt (341) and the battery (39) in the lower shell (20) is accessible. Because the handle (43) of the key (40) is securely held by the tongue (231), the key (40) will not drop even if the lower shell (20) is turned to let the key (40) be oriented downwardly.

Although the invention has been explained in relation to its preferred embodiment, it is to be understood that many other possible modifications and variations can be made without departing from the spirit and scope of the invention as hereinafter claimed.

What is claimed is:

1. A combination of an illuminating casing and a key, said illuminating casing comprising:

a lower shell (20) having a bottom (21) and a peripheral wall (22) extending from the edge defining said bottom (21), a top (23) extending laterally from said peripheral wall and a side plate (230) extending from said bottom (21), said side plate (230) connected to said top (23) so as to define a chamber between said top (23), said bottom (21) and said side plate (230), an insertion slot (24) defined in said peripheral wall (22) and located beneath a first end of said top (23), said insertion slot (24) communicating with said chamber, a tongue (231) extending from a second end of said top (23) and having an inclined surface (2310) with a distal end (2311) directed toward said bottom (21) of said lower shell (20), a groove (235) defined in the top surface of said top (23), an opening (25) defined in said peripheral wall (22) and located beside said insertion slot (24);

an upper shell (30) having a body (301) with a peripheral wall (31) extending from said body (301), said upper shell (30) mountable to said lower shell (20) and having a button (35) attached thereto;

a light (37) received in said opening (25) and having two wires (38, 38') extending therefrom, one of said wires (38) received in said groove (235) and the other wire (38') located to an underside of said button (35);

a battery (39) located on said top (23) and below said button (35), a gap defined between said button (35) and said battery (39) when said button (35) is not pushed, and said key (40) having a shank (42) and a handle (43) which has an aperture (44) defined therethrough, said handle (43) insertable into said chamber from said insertion slot (24) and the distal end (2311) of said inclined surface (2310) engaged with said aperture (44).

2. The combination as claimed in claim 1 further comprising a first engaging member (233) extending from said top of said lower shell (20), said upper shell (30) having a second engaging member (33) extending laterally inward from said peripheral wall (31) thereof so as to be engaged with said first engaging member (233).

3. The combination as claimed in claim 2 wherein said first engaging member (233) is a hook member and said second engaging member (33) has a notch (330) defined therein so as to receive said hook member.

4. The combination as claimed in claim 1 wherein said upper shell (30) has a plurality of bosses (306) extending from the underside of said body (301) so as to press on said battery (39).

5. The combination as claimed in claim 4 wherein said bosses (306) are located around said button (35).

6. The combination as claimed in claim 1 wherein said lower shell (20) has a first lug (202) extending therefrom which has a first slot (204) defined therethrough, said upper shell (30) having a second lug (302) extending therefrom which has a second slot (304) defined therethrough which is in alignment with said first slot (204).

7. The combination as claimed in claim 6 wherein said first lug (202) has two holes (203) respectively defined therethrough, said second lug (302) having two studs (303) respectively extending therefrom so as to be received in said two holes (203).

8. The combination as claimed in claim 1 wherein said lower shell (20) has a tube (26) extending from said bottom (21) thereof and said tube has a threaded hole (261) defined therein, said upper shell (30) having a positioning hole (34) defined therethrough which is in alignment with said threaded hole (261) so that a bolt (341) extends through said positioning hole (34) and is threadedly engaged with said threaded hole (261).

9. The combination as claimed in claim 8 further comprising two positioning posts (340) extending from the underside of said body (301) of said upper shell (30), said tube (26) located between said two positioning posts (340) when said upper shell (30) is mounted to said lower shell (20).

10. The combination as claimed in claim 1 wherein said lower shell (20) has a transparent window (201) defined in said bottom thereof.

11. The combination as claimed in claim 1 further comprising a protrusion (237) extending from said tongue (231) and located in opposite to said inclined surface (2310).

12. The combination as claimed in claim 1 further comprising a stop (236) extending from said top (23) of said lower shell (23) so that said battery (39) is positioned by contacting said stop (236).

13. The combination as claimed in claim 1, wherein said two wires (38, 38') are L-shaped wires.

14. The combination as claimed in claim 1 further comprising a semi-circular recess (220) defined in said peripheral wall (22) thereof and said semi-circular recess (220) communicating with said insertion slot (24).

* * * * *